US005984387A

United States Patent [19]

Zeller

[11] Patent Number: 5,984,387

[45] Date of Patent: Nov. 16, 1999

[54] PORTABLE LOCK

[76] Inventor: Noel E. Zeller, 630 S. Columbus Ave., Harrison, N.Y. 10551-4445

[21] Appl. No.: 08/801,838

[22] Filed: Feb. 14, 1997

[51] Int. Cl.[6] ..... E05C 19/18

[52] U.S. Cl. ..... 292/296; 292/297; 292/292; 292/288

[58] Field of Search ..... 292/289–297

[56] References Cited

U.S. PATENT DOCUMENTS

| | | | |
|---|---|---|---|
| 219,493 | 9/1879 | McKitrick | 292/292 |
| 801,369 | 10/1905 | Dickson et al. | 292/295 |
| 969,631 | 9/1910 | Johnson | 292/293 |
| 1,061,629 | 5/1913 | Parsons | 292/297 |
| 1,947,773 | 2/1934 | Haviland | 292/292 |
| 3,563,593 | 2/1971 | Leier | 292/296 |
| 4,169,619 | 10/1979 | McCracken | 292/290 |
| 4,200,317 | 4/1980 | Polselli et al. | 292/293 |
| 4,878,701 | 11/1989 | Pondel et al. | 292/292 |
| 5,325,685 | 7/1994 | Frank | 70/14 |
| 5,401,068 | 3/1995 | Barnard | 292/289 |
| 5,415,444 | 5/1995 | Hull et al. | 292/288 |
| 5,462,322 | 10/1995 | Berezansky | 292/288 |
| 5,557,956 | 9/1996 | Merz | 70/209 |
| 5,566,993 | 10/1996 | Olivas | 292/292 |
| 5,664,814 | 9/1997 | Lin | 292/297 |

FOREIGN PATENT DOCUMENTS

| | | | |
|---|---|---|---|
| 434583 | 4/1948 | Italy | 292/296 |

*Primary Examiner*—Steven Meyers
*Assistant Examiner*—Teri Pham
*Attorney, Agent, or Firm*—Donald S. Dowden; Cooper & Dunham LLP

[57] ABSTRACT

A portable lock for locking a door has a lock bar for insertion and retention between a door jamb and the latch side of a door. A housing is movable along the lock bar between a retracted position enabling pivoting movement of the door about its hinge between closed and open positions and a forward position engageable with the door in the closed position. A lever arm locking mechanism is movable between first and second positions for locking the housing in the forward position to prevent movement of the door from the closed position to the open position.

12 Claims, 3 Drawing Sheets

PORTABLE LOCK

BACKGROUND OF THE INVENTION

1. Field of the Invention

This invention relates to locks and more particularly to a novel and highly effective portable door lock design, light weight and compact in construction and to a lock that is especially adapted to provide a portable auxiliary personal locking mechanism for a door.

2. Description of the Related Art

Portable locks of many designs are known, including portable door locks. A portable door lock is typically used in addition to existing built in door locking mechanisms, such as a handle lock and/or deadbolt, to lock and secure a door. For example, a traveler may wish to provide an additional personal security measure for locking a hotel or motel room door. Since the keys for these rooms are used by many people, there is always uncertainty regarding who may have keys to a room. Although many hotel or motel room doors may include a slide lock or chain lock in addition to the traditional dead bolt and handle lock, there is generally more comfort and peace of mind knowing that the door is also secured by an additional security device which is known to not have been compromised and which a potential criminal would not be aware of if attempting to enter the room.

However, prior portable door locks leave much to be desired, especially when used under the difficult circumstances frequently encountered by travelers. For example, a portable auxiliary door lock is described in U.S. Pat. No. 5,325,685. The door lock provides for a temporary attachment between the edge of an arcuately hinged door and the adjacent door jamb to secure the door when it is closed. One end of the bar is bent at a 90 degree angle to insert into the latch recess of the striker plate. The lock cylinder faces away from the knob assembly and an additional stop plate is used to retain the door. However, such locks require a key to lock and unlock the lock cylinder. This arrangement is dangerous. Should the key become misplaced after the lock is in place, a person could be trapped in the room in the event of a fire, for example. In addition, such a door lock is awkward to use, since it requires one hand to hold the bar, while sliding the lock cylinder and holding it snugly against the door and at the same time, inserting the key into the lock cylinder and turning it to the locked position.

OBJECTS AND SUMMARY OF THE INVENTION

An object of the invention is to remedy the problems of the prior art noted above and in particular to provide a portable door lock that is lightweight, compact and easy to use and yet rugged and strong enough to withstand the stresses imposed on it when someone attempts to open a door secured by the lock. Another object of She invention is to provide a portable door lock especially adapted to the needs of travelers.

The foregoing and other objects of the invention are attained in accordance with a first aspect thereof by providing a portable lock for locking in a closed position a door having a hinge side and a lock side and capable of pivoting about the hinge side between a closed position and an open position. The lock includes a lock bar for insertion and retention between a door jamb and the latch side of a door. A housing is movable along the lock bar between a retracted position enabling a pivoting movement of the door about the hinge side between closed and open positions and a forward position engageable with the door in the closed position. A lever arm locking mechanism is movable between first and second positions for locking the housing in the forward position to prevent movement of the door from the closed position to the open position. The lock bar is elongate, has two ends, and comprises a blade for insertion and retention between a door jamb and the hinge side of a door. The blade has at least two prongs. One prong is insertable into a latch receiving socket in a door jamb and the other is displaced from the socket to enable a latch to enter the socket.

The door lock according to the present invention is easy and convenient to use, since it requires no key and requires that the lock lever be moved only a quarter turn, and since the locking mechanism automatically draws the lock housing toward the door when the lock lever is moved to the locked position.

BRIEF DESCRIPTION OF THE DRAWINGS

A better understanding of the objects, features and advantages of the invention can be gained from the following detailed description of the preferred embodiment, wherein a given reference character always refers to the same element or part, and wherein.

DESCRIPTION OF THE PREFERRED EMBODIMENT

Figure 3:
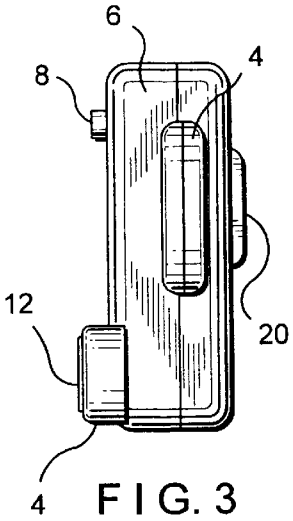
FIG. 3 is a view of the portable door lock taken along the lines 3—3 in FIG. 1.
Figure 4:
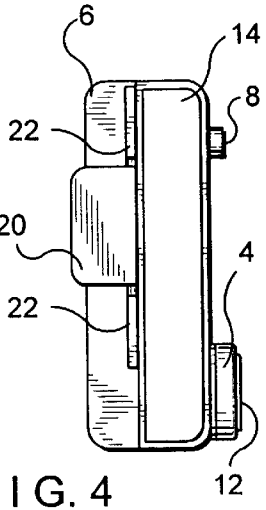
FIG. 4 is a view of the portable door lock taken along the lines 4—4 in FIG. 1.

The portable door lock according to an aspect of the present invention is shown in FIGS. 1–4. The main components of the door lock consist of a lock housing 18, a lock bar 2 and a lever arm 10. A cushion or pad 14 is mounted to a front face or surface of the lock housing 18. The cushion 14 abuts the door when the lock is in place, to provide a secure fit while preventing marring, scratching or other damage to the door. Lever arm 10 is pivotable between an unlocked first position shown in FIGS. 1 and 5 and a locked second position shown in FIGS. 2 and 6. Stops 8 and 9 are provided on the lock housing 18 to prevent the lever arm 10 from moving beyond its intended range of motion. The lock bar 2 consists of a metal blade. One end of the lock bar 2 has a middle prong 20 and outer prongs 22 on either side of the middle prong 20. The middle prong 20 extends at a right angle from the lock bar 2 and is insertable into a latch-receiving socket in a door jamb. When in place, the outer prongs 22 are displaced from the latch-receiving socket in the door jamb on either side, enabling a door latch to enter the socket. One edge of the lock bar 2 has gear teeth 16 forming a portion of the locking mechanism of the door lock. The lock bar 2 is slidably mounted within the lock housing 18 so that the lock housing 18 can be moved to any desired position along the lock bar 2 and then locked into that position with the lever arm 10.

Figure 1:
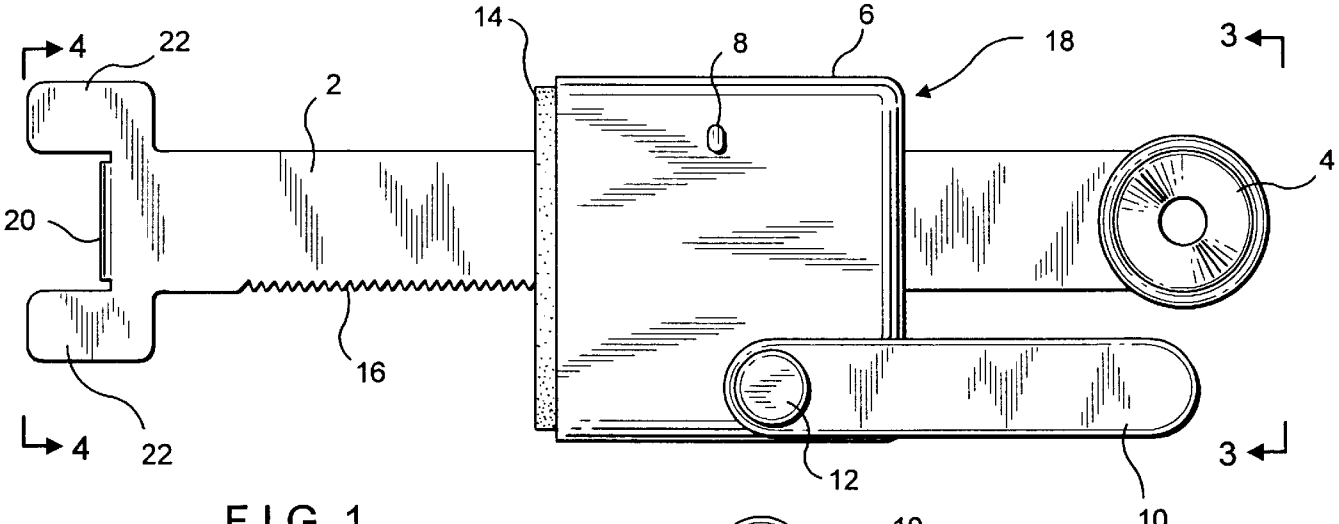
FIG. 1 is a side view of a portable door lock in an unlocked state, according to an embodiment of the present invention.
Figure 2:
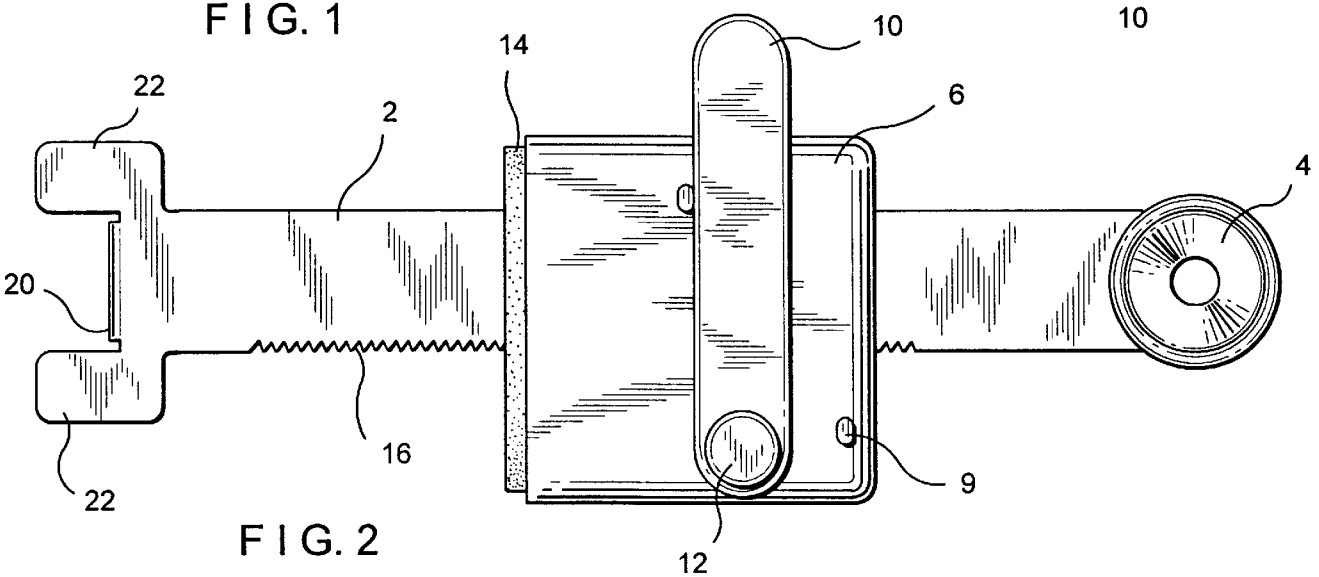
FIG. 2 is a side view of a portable door lock in a locked state, according to the embodiment of the present invention.

When the lever arm 10 is in the unlocked position shown in FIG. 1, the lock bar 2 is freely movable with respect to housing 18 between a retracted position (which enables the lock to be removed allowing pivoting movement of the door about the hinge side between closed and open positions) and a forward position engageable with the door when the door is closed. When locked in this forward position, cushion 14 abuts the door, thereby preventing the door from opening. A detent mechanism is preferably provided within housing 18 for providing a detent action to the lock bar 2 as it is moved between positions. Lever arm 10 controls a lock mechanism within lock housing 18 so that when lever arm 10 is moved to the locked position shown in FIG. 2, lock bar 2 is prevented from further movement with respect to lock housing 18. The detent mechanism and lock mechanism will now be described in more detail by reference to FIGS. 5–7.

Figure 7:
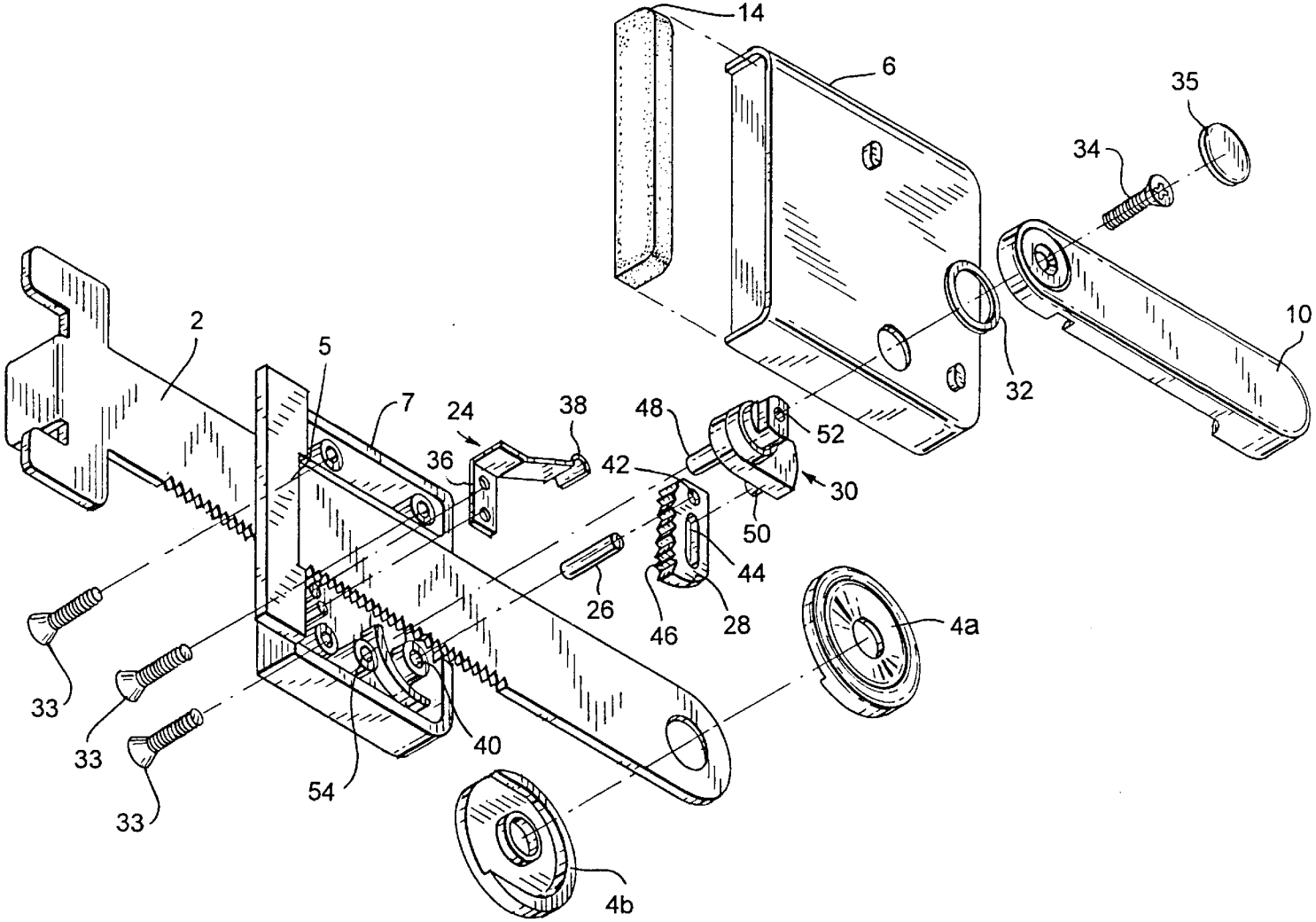
FIG. 7 is an exploded view of the portable door lock according to the embodiment of the present invention.

The main components of the lock mechanism are shown in FIG. 7 and consist of a locking gear 28, a crank arm 30, a lever arm 10, a detent spring 24, an axle 26 and a washer 32. The rear housing 7 includes a slot 5 through which the lock bar 2 is received. The detent spring 24 includes a mounting bracket section 36 for mounting to the rear housing 7, for example, with screws or using a plastic spot welding technique. Detent spring 24 also includes a spring arm section including an end tip portion 38 that makes contact with the teeth 16 of the lock bar 2, and provides a ratchet or detent action to the lock bar 2 when the lock bar 2 is moved between positions. The axle 26 rests in and extends from hole 40 in rear housing 7. The axle 26 extends through the pivot hole 42 in the locking gear 28 so that the locking gear 28 is pivotable about the axle 26. The locking gear 28 is also supported by a slide surface 56 provided on the rear housing 7. Locking gear 28 includes an edge having teeth 46 which are dimensioned to mesh with the teeth 16 of lock bar 2. The crank arm 30 consists of a molded piece of plastic, for example, and includes a pivot pin 48, cam slot pin 50 and keyed handle arm 52. The pivot pin 48 sits within the pivot pin hole 54 formed in the rear housing 7. The cam slot pin 50 rides within the cam slot 44 of the locking gear 28. The keyed handle arm 52 extends through the front housing 6. The washer 32 slips over the arm 52. The lever arm 10 is keyed (not shown) to correspond to keyed handle arm 52 so that arm 10 can be slipped over the arm 52 and held in place with handle screw 34. Screw cover 35 covers screw 34 and provides a decorative finish to the lever arm. Screws 33 extend through the rear housing 7 and into corresponding threaded holes (not shown) provided in the front housing 6 to hold the unit together. As shown, two sections of molded plastic 4*a* and 4*b* make up a finger grip 4. The cushion 14 is secured to front housing 6 by glue, for example.

Operation of the lock will now be described by reference to FIGS. 5 and 6. The lock assembly is shown in the unlocked position in FIG. 5. As shown, the cam slot pin 50 rests in the cam slot 44 in locking gear 28. When the crank arm 30 is rotated (by movement of lever arm 10) in the direction indicated by arrow a (i.e., in the counterclockwise direction as viewed in FIG. 5), the cam slot pin 50 moves within the cam slot 44 causing the locking gear 28 to pivot about the axle 26 in a clockwise direction, until the fully extended locked position is reached, as shown in FIG. 6. In this position, the teeth 46 of the locking gear 28 engage the teeth 16 of the lock bar 2 and prevent movement of the lock bar 2 with respect to the lock housing 18.

Figure 5:
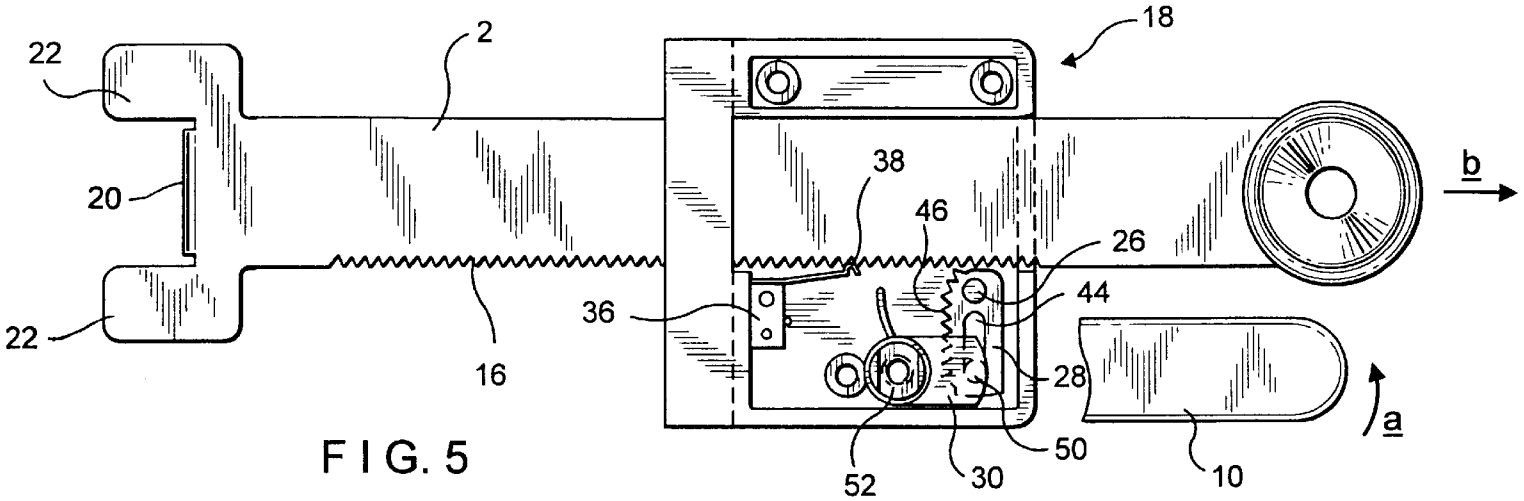
FIG. 5 is a sectional view of the portable door lock in the unlocked state, according to the embodiment of the present invention.
Figure 6:
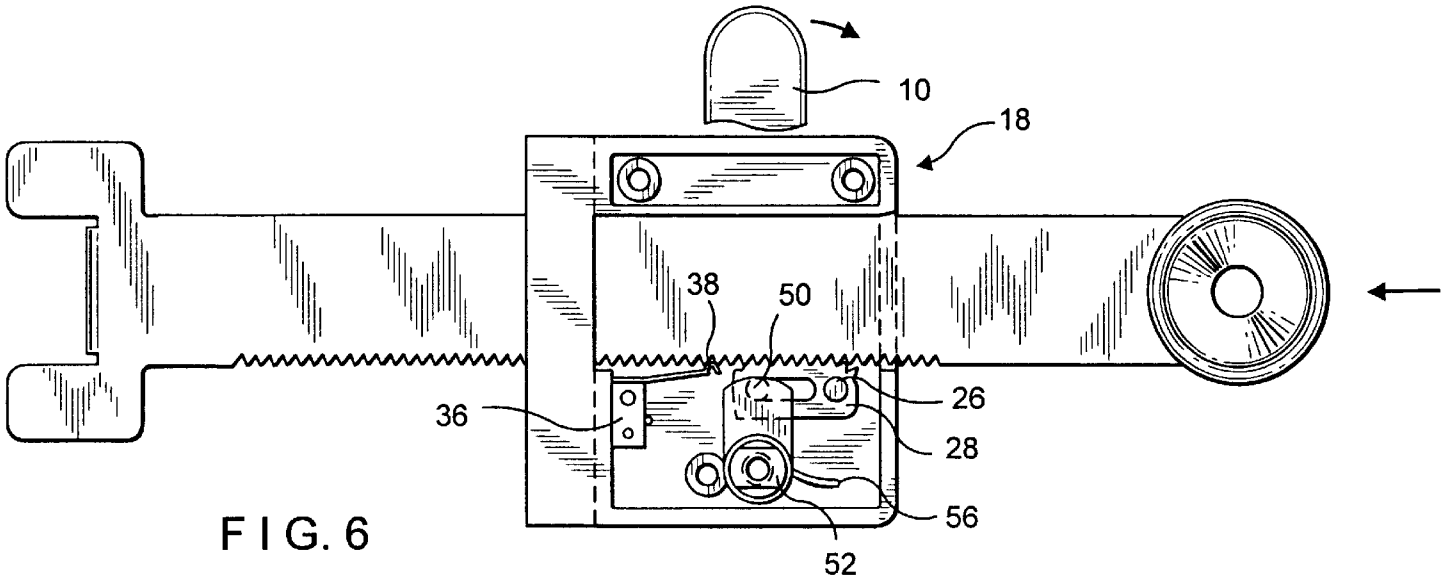
FIG. 6 is a sectional view of the portable door lock in the locked state according to the embodiment of the present invention.

As shown in FIGS. 5 and 6, the teeth 46 along the edge of the locking gear 28 extend slightly around the circumference of the edge of locking gear 28 closest to the axle 26. Accordingly, as lever arm 10 is moved in the counterclockwise direction as shown in FIG. 5, the first tooth on locking gear 28 contacts the teeth 16 on locking bar 2. As lever arm 10 is further moved in the counterclockwise direction, lock bar 2 is moved in the direction indicated by arrow b in FIG. 5. This feature, when the portable door lock is positioned on the door, draws the portable lock housing 18 into the door making for a secure, snug fit. As shown, only a quarter turn of the lever arm 2 separates the locked and unlocked positions, thus enabling the door lock to be easily positioned and locked.

It will be appreciated that various changes in the details, materials, and arrangements of the parts that have been described and illustrated in order to explain the nature of this invention may be made by those skilled in the art without departing from the spirit of the present invention, the scope of which is limited only by the following claims.

What I claim is:

1. A portable lock for locking in a closed position a door having a hinge side and a lock side and capable of pivoting about the hinge side between a closed position and an open position, said lock comprising:

a lock bar for insertion and retention between a door jamb and the latch side of a door;

a housing movable along said lock bar between a retracted position enabling a pivoting movement of the door about the hinge side between closed and open positions and a forward position engageable with the door in the closed position; and a lever arm locking mechanism movable between first and second positions and including means for first snubbing said housing towards the door and then locking said housing in said forward position to prevent movement of the door from the closed position to the open position.

2. A portable lock according to claim 1 wherein said lock bar is enlongate, has two ends, and comprises a blade for insertion and retention between a door jamb and the lock side of a door.

3. A lock bar according to claim 2 wherein said blade has at least two prongs.

4. A lock bar according to claim 3 wherein one prong is insertable into a latch receiving socket in a door jamb and the other prong is displaced from the socket to enable a latch to enter the socket.

5. A portable lock according to claim 2 wherein said blade has a middle prong and outer prongs on either side of the middle prong, the middle prong is insertable into a latch-receiving socket in a door jamb and the outer prongs are displaced from the socket on either side to enable a latch to enter the socket.

6. A portable lock according to claim 1 wherein said lock bar is formed with gear teeth, further comprising a locking gear movable by said lever arm thereon for selectively engaging and disengaging said locking gear with and from said gear teeth.

7. A portable lock according to claim 6 wherein said lever arm is pivotable between the first position disengaging said locking gear from said gear teeth and the second position engaging said locking gear with said gear teeth.

8. A portable lock according to claim 7 wherein said lever arm in said first position extends horizontally.

9. A portable lock according to claim 7 wherein said lever arm in said second position extends vertically.

10. A portable lock according to claim 7 wherein a quarter turn of said lever arm separates said first and second positions.

11. A portable lock according to claim 7 wherein said lever arm in said first position extends horizontally and in said second position extends vertically and a quarter turn of said lever arm separates said first and second positions.

12. A portable lock according to claim 1 further comprising means for moving said housing along said lock bar in discrete steps.

* * * * *